US005778650A

United States Patent [19]

Broich et al.

[11] Patent Number: 5,778,650

[45] Date of Patent: Jul. 14, 1998

[54] DEVICE FOR STOPPING A SPINDLE OF A TEXTILE MACHINE DRIVEN BY A DRIVE BELT

[75] Inventors: Wilfried Broich, Mönchengladbach; Heinz Fink, Krefeld; Jürgen Kallmann, Kaarst; Wolfgang Leupers, Mönchengladbach, all of Germany

[73] Assignee: Palitex Project-Company GmbH, Krefeld, Germany

[21] Appl. No.: 773,021

[22] Filed: Dec. 24, 1996

[30] Foreign Application Priority Data

Dec. 30, 1995 [DE] Germany ..... 195 49 163.7

[51] Int. Cl.[6] ..... D01H 13/18

[52] U.S. Cl. ..... 57/88; 57/80; 188/74; 188/82.7

[58] Field of Search ..... 57/80, 88; 242/129.8, 242/422.4; 188/74, 82.1, 82.3, 82.77, 82.7

[56] References Cited

U.S. PATENT DOCUMENTS

| | | | |
|---|---|---|---|
| 2,211,077 | 8/1940 | Schlums | 57/88 |
| 3,354,627 | 11/1967 | Cizek et al. | 57/80 |
| 3,681,908 | 8/1972 | Hohloch | 57/88 |
| 3,765,161 | 10/1973 | Kohler | 57/88 |
| 3,805,504 | 4/1974 | Fauzen | 57/88 |
| 3,868,815 | 3/1975 | Stahlecker | 57/88 |
| 4,098,066 | 7/1978 | Stahlecker | 57/80 |
| 4,920,736 | 5/1990 | Stahlecker | 57/80 |

FOREIGN PATENT DOCUMENTS

| | | | |
|---|---|---|---|
| 1080002 | 4/1960 | Germany . | |
| 1239966 | 5/1967 | Germany . | |
| 2089847 | 6/1982 | United Kingdom | 57/88 |

*Primary Examiner*—Chris Schwartz
*Attorney, Agent, or Firm*—Robert W. Becker & Associates

[57] ABSTRACT

A device for stopping a spindle of a textile machine driven by a drive belt has a roller for removing the drive belt from contact with the spindle whorl of the spindle. The roller is movable from a rest position, in which the roller is disengaged from the drive belt, into an engaged position in which the roller engages the drive belt and moves the drive belt away from the spindle whorl. A brake device for braking the spindle whorl is provided. A support member on which the roller rests in its rest position so as to be vibration-dampened is connected to the support of the textile machine.

8 Claims, 2 Drawing Sheets

DEVICE FOR STOPPING A SPINDLE OF A TEXTILE MACHINE DRIVEN BY A DRIVE BELT

BACKGROUND OF THE INVENTION

The invention relates to a device for stopping a spindle of a textile machine driven by a drive belt. The device comprises a roller for removing the drive belt from contact with the spindle whorl which roller is movable between a rest position and an engaged position in which the roller engages the drive belt and moves the drive belt away from the spindle whorl. The device further includes a brake device for braking the spindle whorl.

Such a device is disclosed in German Patent 1 239 966 and is used for stopping a spindle driven by a tangential drive belt. A roller is moved to force the tangential drive belt away from the spindle. German Patent 1 080 002 also shows a device for stopping a spindle with the aid of a roller. In this embodiment the drive belt corresponds to a belt drive for one or multiple spindles.

All devices comprising a roller for removing the drive belt from the spindle have the disadvantage that the roller contacts the drive belt and rotates with the drive belt only for the time period in which the spindle is stopped. During most of the operating time of the textile machine this roller is in a rest position in which it is removed from the belt drive and stopped. However, stopped bearings are always at risk when they are supported by holders and positioned in the vicinity of elements that rotate at high rpm. Elements rotating at high rpm cause short-wave vibrations that are transferred onto the bearing of the roller and have a destructive effect.

It is therefore an object of the present invention to improve a device of the aforementioned kind such that the rotational bearing, especially a ball bearing, of such rollers is protected from vibration-caused destruction during standstill of the roller.

SUMMARY OF THE INVENTION

The device for stopping a spindle of a textile machine driven by a drive belt according to the present invention is primarily characterized by:

A roller for removing a drive belt from contact with a spindle whorl of the spindle, the roller movable from a rest position in which the roller is disengaged from the drive belt into an engaged position in which the roller engages the drive belt and moves the drive belt away from the spindle whorl;

A brake device for braking the spindle whorl;

A support member on which the roller rests in the rest position so as to be vibration-dampened.

Advantageously, the support member comprises an elastic element and the roller rests on the elastic element for vibration-dampening.

The support member preferably comprises a ball bearing.

Advantageously, the device further comprises a pivot lever on which the roller is mounted. The device also may comprise a means for returning by elastic force the roller from the engaged position into the rest position and for pressing the roller against the support member in the rest position.

Preferably the device further comprises a pressure cylinder mounted on the pivot lever for forcing the roller from the rest position into the engaged position.

The brake device is located at the spindle whorl opposite the drive belt and comprises a brake shoe holder with brake shoes. The brake shoe holder is pivotably mounted on the pivot lever and is elastically supported at the pivot lever on opposite sides of a pivot axis of the brake shoe holder.

The brake shoe holder has a backside and comprises elastic pads mounted to the backside. The elastic pads are resting on the pivot lever.

Preferably, the support member comprises a gudgeon extending parallel to the axis of rotation of the roller. The gudgeon has an elastic coating extending at least over a portion of the periphery of the gudgeon.

According to the present invention, the device comprises a support member at which the roller in its rest position rests in a vibration-dampening manner. Upon return of the roller into its rest position, it is thus pivoted into an elastic cushion so that this cushion provides a vibration dampening effect on the roller so that bearing play is eliminated at the same time.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

The present invention will now be described in detail with the aid of a specific embodiment utilizing FIGS. 1 through 3.

Figure 1:
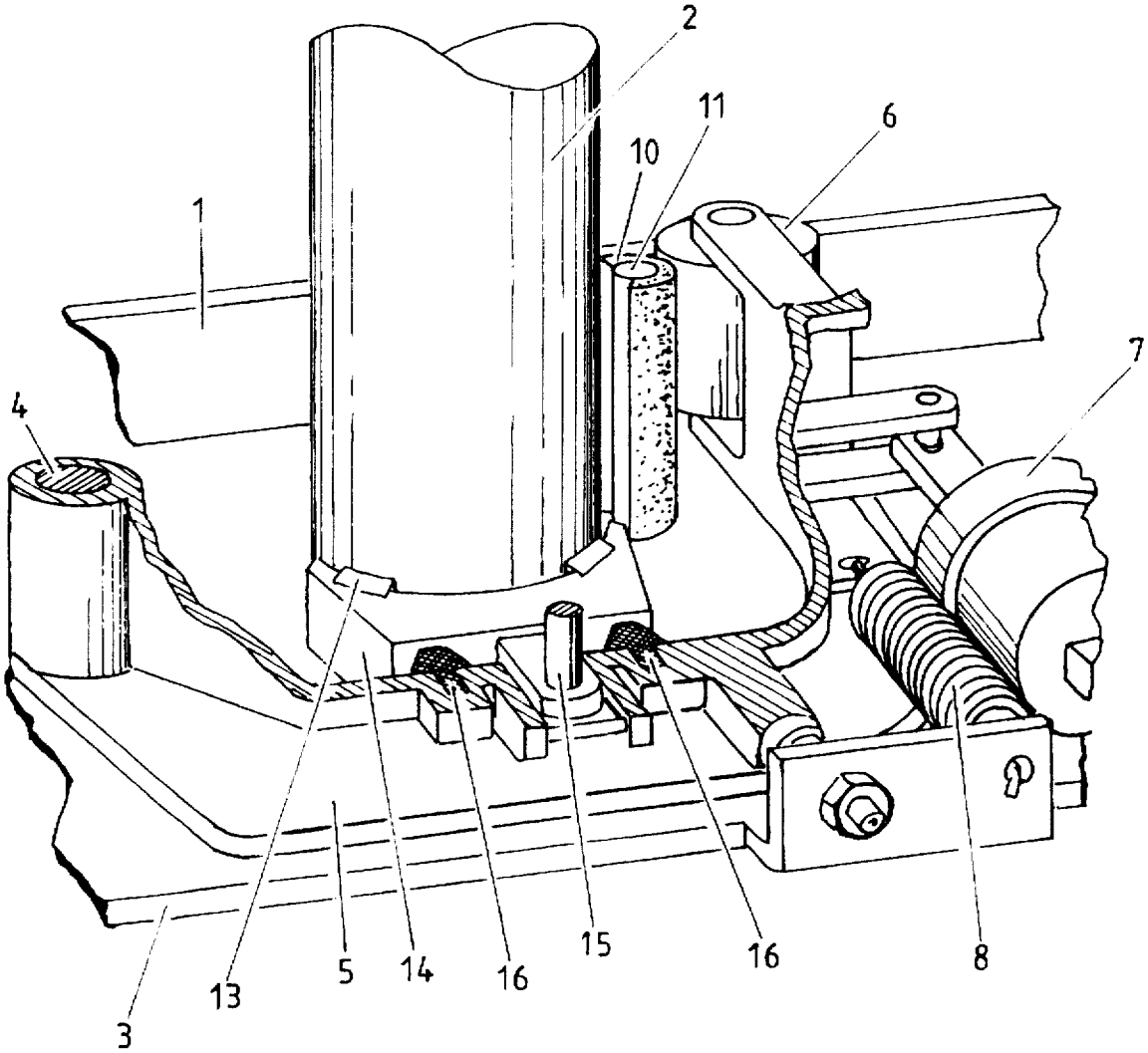
FIG. 1 shows the inventive device in a perspective view illustrating the arrangement of the spindle whorl relative to the stopping device.

A tangential drive belt 1, only a portion of which is represented in FIG. 1, serves to drive a spindle whorl 2 of a spindle which in a conventional, non-represented manner, is supported on the machine frame of a multi-station textile machine. To a support 3, forming part of the otherwise not represented machine frame, a pivotable pivot lever 5 is connected which can be pivoted about the axle 4 and which in the shown embodiment has substantially a U-shape. To the free end of the pivot lever 5 a roller 6 is rotatably mounted. It serves to push the drive belt away from the spindle whorl 2 when in its engaged position (see FIG. 2).

Figure 2:
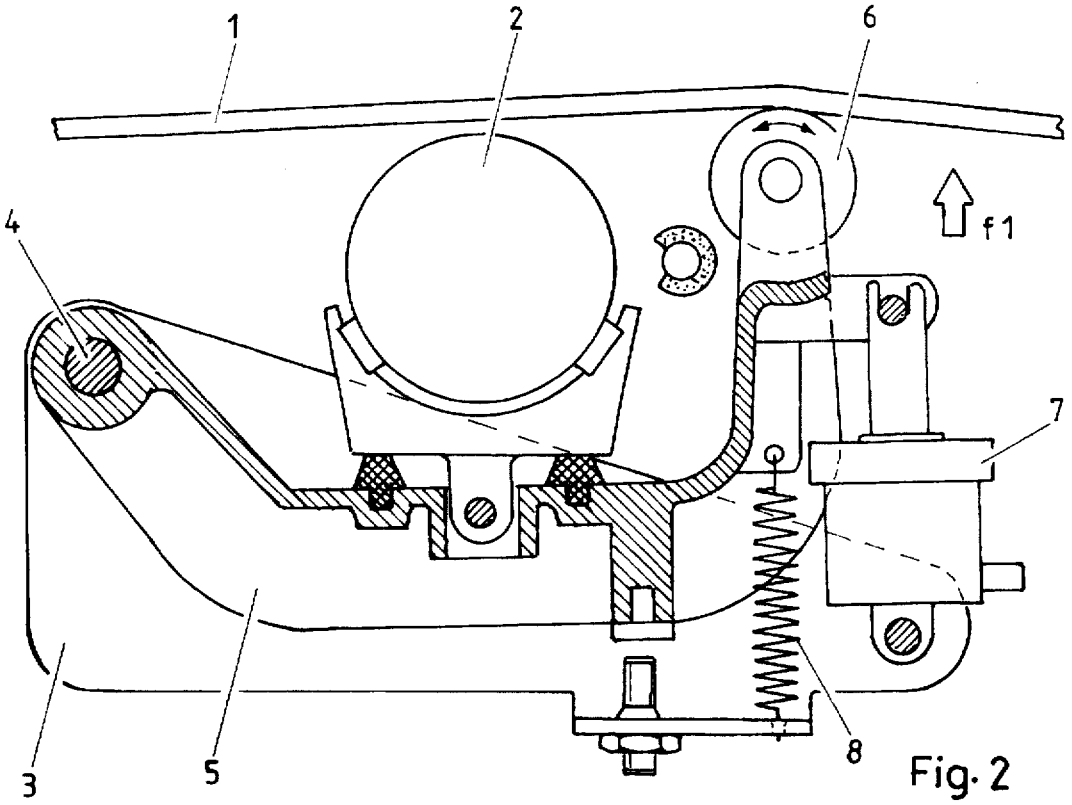
FIG. 2 shows a horizontal section of the inventive device with the spindle whorl being stopped.

A drive cylinder 7 connected to the support 3 serves to displace the pivot lever 5 in the direction of arrow f1 in order to bring the roller 6 into contact with the drive belt 1 so that the drive belt 1 is lifted off the spindle whorl 2 (see FIG. 2). A return spring 8 engages the pivot lever 5 in order to return the pivot lever 5, after the pressure is released from the drive cylinder 7, in the direction of arrow f2 so that the roller 6 is removed from the drive belt 1. The drive belt 1 again comes into contact with the spindle whorl 2, aided by non-represented belt-biasing rollers so that the spindle whorl 2, depending on the running direction of drive belt 1, is driven in one of the two directions indicated by double arrow f3.

Figure 3:
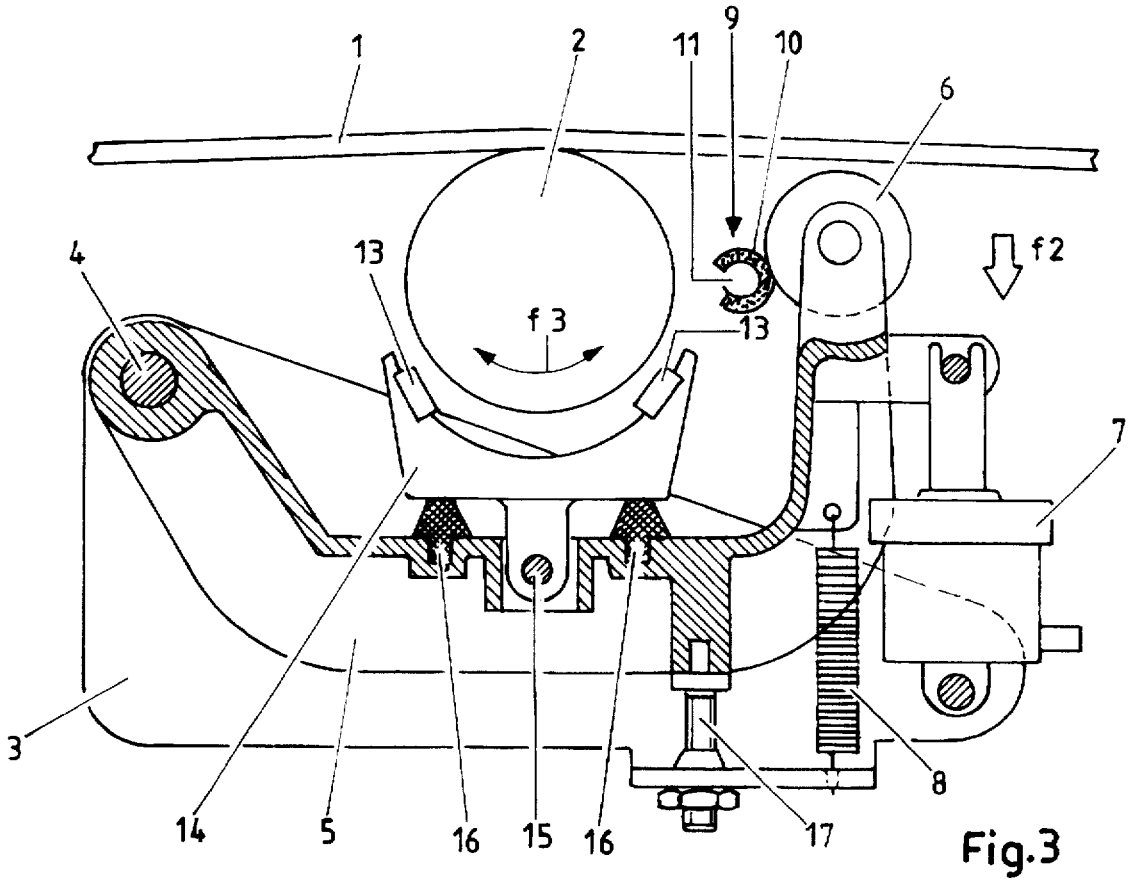
FIG. 3 shows a horizontal section of the inventive device with the spindle whorl being driven by the drive belt and the roller in its rest position.

In order to prevent vibration-caused bearing damage at the roller 6 when the position according to FIG. 3, especially when ballbearing-supported (6*a*), a support member 9 is provided which comprises preferably a gudgeon 11 extending parallel to the rotational axis of the roller 6. The support member 9 has an elastic pad 10.

A brake shoe holder 14 provided with brake shoes 13 is located opposite the drive belt I and fastened to the pivot lever 5 so as to be pivotable about the axle 15. To both sides of the pivot axis 15 elastic pads 16 are provided to the holder 14 so that the holder 14 is elastically supported at the pivot lever 5. This arrangement of the brake shoe holder 14 ensures a reliable application of the brake shoes 13 at the spindle whorl 2 independent of its direction of rotation.

An abutment 17 is connected to the support 3 in order to limit the return movement of the pivot lever 5 into the rest position of the roller 6 and of the brake shoes 13 caused by the return spring 8.

The present invention is, of course, in no way restricted to the specific disclosure of the specification and drawings, but also encompasses any modifications within the scope of the appended claims.

What we claim is:

1. A device for stopping a spindle of a textile machine driven by a drive belt, said device comprising:

a roller for removing a drive belt from contact with a spindle whorl of the spindle, said roller movable from a rest position in which said roller is disengaged from the drive belt into an engaged position in which said roller engages the drive belt and moves the drive belt away from the spindle whorl;

a brake device for braking the spindle whorl;

a support member, positioned laterally adjacent to said roller, wherein said roller is moved against said support member when returned into said rest position and rests in said rest position on said support member so as to be vibration-dampened and is moved away from said support member when returned into said engaged position.

2. A device according to claim 1, further comprising:

a pivot lever on which said roller is mounted;

a means for returning by elastic force said roller from said engaged position into said rest position and for pressing said roller against said support member in said rest position.

3. A device according to claim 2, wherein said brake device is located at the spindle whorl opposite the drive belt and comprises a brake shoe holder with brake shoes, wherein said brake shoe holder is pivotably mounted on said pivot lever and is elastically supported at said pivot lever on opposite sides of a pivot axis of said brake shoe holder.

4. A device according to claim 3, wherein said brake shoe holder has a back side and comprises elastic pads mounted to said back side, said elastic pads resting on said pivot lever.

5. A device according to claim 2, further comprising a drive cylinder mounted on said pivot lever for forcing said roller from said rest position into said engaged position.

6. A device according to claim 1, wherein said support member comprises an elastic element and wherein said roller rests on said elastic element for vibration-dampening.

7. A device according to claim 1, wherein said roller comprises a ball bearing.

8. A device according to claim 1, wherein said support member comprises a gudgeon extending parallel to an axis of rotation of said roller, said gudgeon having an elastic coating extending at least over a portion of a periphery of said gudgeon.

* * * * *